US005542195A

United States Patent [19]

Sessa

[11] Patent Number: 5,542,195

[45] Date of Patent: Aug. 6, 1996

[54] SHOE CONSTRUCTION WITH INTERNAL CUSHIONING RIBS

[75] Inventor: Raymond V. Sessa, Grand Rapids, Mich.

[73] Assignee: Wolverine World Wide, Inc., Rockford, Mich.

[21] Appl. No.: 570,357

[22] Filed: Dec. 11, 1995

Related U.S. Application Data

[63] Continuation of Ser. No. 191,024, Feb. 2, 1994, abandoned.

[51] Int. Cl.[6] ..... A43B 13/38

[52] U.S. Cl. ..... 36/28; 36/30 R

[58] Field of Search ..... 36/28, 30 R, 31, 36/114, 27, 37, 30 A, 29, 59 C, 59 R

[56] References Cited

U.S. PATENT DOCUMENTS

| | | | |
|---|---|---|---|
| D 190,162 | 4/1961 | Hubbard | 36/59 C |
| D 311,989 | 11/1990 | Parker et al. . | |
| 1,165,847 | 12/1915 | Cashman | 36/37 |
| 1,559,532 | 10/1925 | Smith | 36/28 |
| 1,981,300 | 11/1934 | Berg . | |
| 2,090,881 | 8/1937 | Wilson . | |
| 2,710,461 | 6/1955 | Hack . | |
| 2,833,057 | 5/1958 | Hack . | |
| 2,930,149 | 3/1960 | Hack et al. . | |
| 2,937,462 | 5/1960 | Hack et al. . | |
| 2,941,316 | 6/1960 | Hack . | |
| 2,941,317 | 6/1960 | Hack . | |
| 2,963,800 | 12/1960 | Hack . | |
| 2,994,326 | 8/1961 | Hack . | |
| 3,005,272 | 10/1961 | Shelare et al. | 36/29 |
| 3,006,085 | 10/1961 | Bingham, Jr. | 36/59 C |
| 3,012,342 | 12/1961 | Ramirez . | |
| 3,079,707 | 3/1963 | Hack et al. . | |
| 3,079,708 | 3/1963 | Hack et al. . | |
| 3,299,544 | 1/1967 | Hack . | |
| 3,426,455 | 2/1969 | Drago . | |
| 3,444,632 | 5/1969 | Hack et al. . | |
| 3,507,059 | 4/1970 | Vietas | 36/59 C |
| 3,717,943 | 2/1973 | Orandorff, Jr. | 36/59 C |
| 4,120,102 | 10/1978 | Kengson | 36/37 |
| 4,319,412 | 3/1982 | Muller et al. . | |
| 4,347,673 | 9/1982 | Svetlik . | |
| 4,712,314 | 12/1987 | Sigoloff . | |
| 4,817,304 | 4/1989 | Parker et al. . | |
| 4,845,863 | 7/1989 | Yung-Mao | 36/28 |
| 4,910,882 | 3/1990 | Goller . | |
| 4,974,345 | 12/1990 | Yung-Mao | 36/28 |
| 5,199,191 | 4/1993 | Moumdjian . | |
| 5,255,451 | 10/1993 | Tong et al. | 36/28 |

FOREIGN PATENT DOCUMENTS

| | | | |
|---|---|---|---|
| 1302331 | 7/1962 | France | 36/29 |
| 137555 | 10/1952 | Sweden | 36/30 R |
| 1444091 | 7/1976 | United Kingdom | 36/28 |
| WO81/02969 | 10/1981 | WIPO | 36/29 |

*Primary Examiner*—Ted Kavanaugh
*Attorney, Agent, or Firm*—Warner Norcross & Judd

[57] ABSTRACT

This cushioned shoe construction has an insert above the outer sole. The insert has transverse ridges tapered downwardly to reduced width, and angled toward the arched area of the shoe. The outsole is a relatively hard material selected for wear resistance, and has a translucent area to render the ribs visible. The insert is of a more resilient material.

11 Claims, 4 Drawing Sheets

SHOE CONSTRUCTION WITH INTERNAL CUSHIONING RIBS

This application is a continuation of application Ser. No. 08/191,024 filed Feb. 2, 1994, now abandoned.

RELATED FIELD

This invention relates to shoe construction, which includes sandals and other types of footwear as well as shoes.

BACKGROUND OF THE INVENTION

Informal and sports shoes have used a variety of constructions to provide resilience while giving the needed support to the foot. Sponge rubber soles are common, but the resilience of these is limited because of being in the form of a continuous mass of material across the entire area of the sole. This continuity of material prevents significant lateral deflection, and thus limits vertical displacement unless the sponge has so much entrained air that wear characteristics are reduced. Another expedient has been the use of transverse ribs, where the spaces between them allows more expansion to provide for vertical compression of the ribs under load. Here, again, compromise has been necessary between the hardness required for wear, and the soft resilience needed for shock absorption. Some shoes employ inclined ribs wherein the ribs bend as well as compress in order to provide a softer cushion for the feet.

Typically, these features have been incorporated in the outsole of a laminated sole construction in which a wear resistant outsole is secured to an upper structure of the shoe. The shoe upper that covers the foot can either continue under the foot, as in a moccasin construction, or it can terminate at the edge of the sole. In the latter case, the upper typically is cemented to a thin fibrous insole board when the upper is formed or lasted, and the outsole is mounted on the underside of the insole board. A soft, cushioned insole fits in the inside of the shoe on top of the insole board and is frequently removable.

Where the cleats or ribs are provided over the bottom surface of the outsole, experience has shown that this arrangement invites the accumulation of mud and other foreign material which interferes with deflection, and has the undesirable side effect of bringing dirt along with the shoe wherever it goes. Some attempts have been made to avoid the dirt dragging problem by placing the ribs on the top of the outsole adjacent the upper or the insole board.

SUMMARY OF THE INVENTION

A shoe incorporating the present invention has an outsole formed of a material selected for wear characteristics and flexibility and an insert positioned in a recess at the upper side of the outsole adjacent the upper structure of the shoe. The insert is formed of a material selected for resilience rather than wear and includes transverse ribs tapering to reduced thickness at the outsole. These ribs desirably are inclined and preferably have their axes inclined toward the central area of the shoe (with respect to the length of the shoe). This central position is commonly referred to as the arch of the shoe. The outsole may be provided with translucent or transparent areas to render the ribs of the insert visible.

DESCRIPTION OF THE PREFERRED EMBODIMENTS

Figure 1:
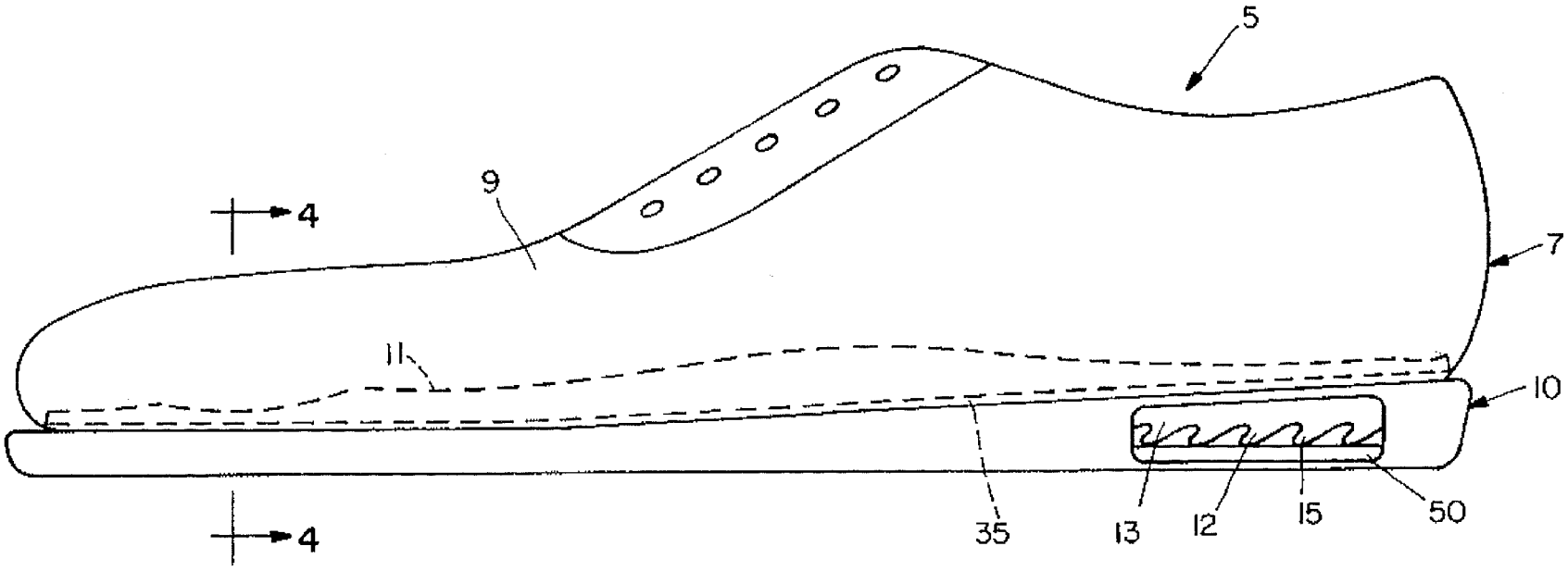
FIG. 1 is a side elevation of a shoe showing the outsole of the present invention mounted on a conventional shoe upper.
Figure 2:
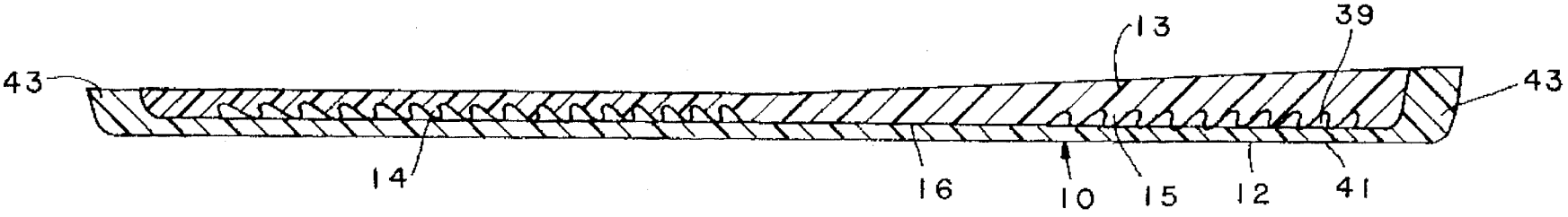
FIG. 2 is a side elevational cross sectional view of the outsole of the present invention.
Figure 3:
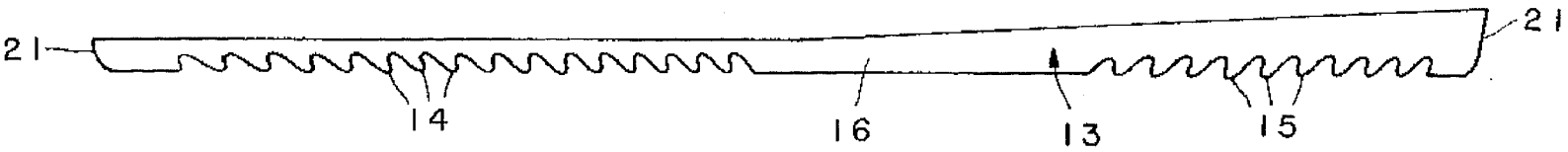
FIG. 3 is a side elevation showing the insert of the present invention.
Figure 4:
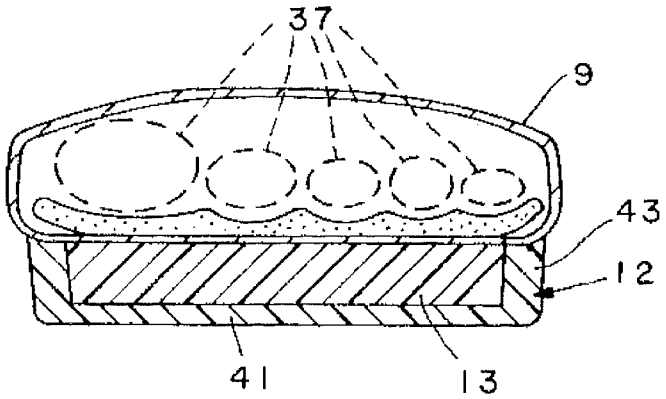
FIG. 4 is a sectional view taken along line 4—4 of FIG. 1.

FIG. 1 shows a shoe 5 employing an outsole assembly 10 mounted on an upper assembly 7 which includes upper 9 that at least partially covers the foot. As used herein the term "shoe" is intended to include sandals, boots, and similar footwear in addition to conventional shoes. The upper either extends under the foot or terminates at the edge of the outsole and is attached to a fibrous insole board 35. A cushioned insole 11, which may be removable, fits in the upper and may be considered as a part of the upper structure of the shoe. The outsole and insole of shoe 7 are of conventional thickness and the upper is of conventional height to provide adequate room for toes 37 as shown in FIG. 4. In FIG. 2, we are looking at the components of the outsole assembly 10, which includes the outsole itself 12 and a ribbed outsole insert 13 that fits in a recess 39 in the upper surface of the outsole, leaving a bottom 41 and side edges 43. The insert is cemented to the recess around the edges 21 and also at a non-ribbed portion 16 at the center of the insert. The ribs themselves are not cemented to the outsole so as to permit movement of the ribs in bending and flexing. In FIG. 3, the insert 13 is shown separate from the outsole element 12. FIG. 4 shows the FIG. 1 assembly in transverse section.

Figure 5:
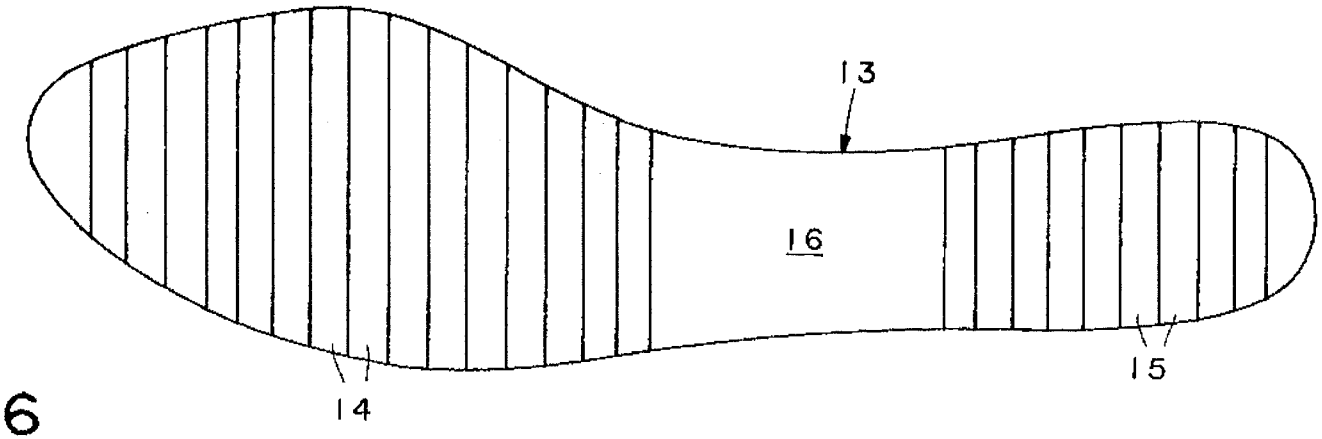
FIG. 5 is a bottom view of the outsole insert.

The outsole insert 13 has a series of transverse ribs 14 distributed over the forward portion of the shoe, and a series of ribs 15 transversely arranged along the heel area. These ribs are generally of a rounded triangular cross-section tapering toward reduced thickness toward the bottom 41 of outsole 12. The forward group 14 has their axes inclined rearwardly toward the central arch area 16, while the rear group of ribs 15 is oppositely inclined also toward the central arch area. Because of the inclined position of the ribs, the ribs both bend and compress when the sole is walked on. The rear ribs are inclined forwardly to provide improved impact resistance in the heel area. As the foot comes down to the ground during the normal walking stride, an impact force on the heel area at the rear is first encountered, and this is received by the ribs 15 in a forwardly and downwardly inclined direction similar to the axes of the ribs. This provides for an improved compression resistance of the ribs at the heel, rather than subjecting them to a more severe bending action, which occurs at the forward portion of the shoe. The forward portion of the shoe thus has a more resilient feel than the heel portion. These forces also tend to compress the ribs as well as bend the ribs, providing a desirable resilient feel for the foot. FIG. 5 shows the transverse orientation of the ribs 14 and 15.

An important feature of the present invention is that the insert and outsole can be formed of materials having differing resilience characteristics. The outsole is formed of a natural or synthetic resin having good wear qualities, while the insert is formed of a natural or synthetic resin having more resilience qualities than the outsole. This provides improved comfort in a sole no thicker than a conventional sole and without exposed ribs that pick up dirt.

In the present invention, outsole 12 is preferably made from a thermoplastic rubber or TPR. TPR is formed by heating the substance past its melting point and then injecting it into a mold. As the substance cools, it hardens into the shape of the mold. TPR has very little air intermixed with the substance. The density of the material is on the order of 85% to 90%. Outsole 12 could be made from a variety of materials including polyvinylchloride. However, it is preferably made from TPR having a durometer hardness of 60–64 on the Shore type A scale. The Shore type A scale varies from 0–100 with 0 representing no hardness and 100 representing the hardness of steel. TPR with a 60–64 durometer hardness has the preferred resiliency and abrasion resistance.

Insert 13 may also be made from a variety of materials including TPR but is preferably made from closed cell polyurethane. Polyurethane is made from a combination of separate liquids which react to form a polyurethane foam. Polyurethane resembles bread in that a foam interior is surrounded at the periphery by a polyurethane "crust" or "skin". This skin is substantially harder than the interior foam which makes testing via a durometer impractical.

When polyurethane has a closed cell configuration the characteristics are usually measured as a percentage of weight to volume or density. The closed cell configuration indicates that the foam includes a plurality of encapsulated air pockets which do not communicate air with other air pockets. For insert 13, the preferred density of closed cell polyurethane is on the order of 53–57%.

The insole, on the other hand, can be a conventional elastic foam insole formed of a lighter weight polyurethane in an open construction to provide absorbency. Such an insole provides a soft, cushioned feel and conforms to the foot. The insole can be softer and more compressible and deformable than the insert, which does not have to conform with the shape of the foot to the same extent as the insole. The insole board provides some isolation between the outsole insert and the insole.

Figure 6:
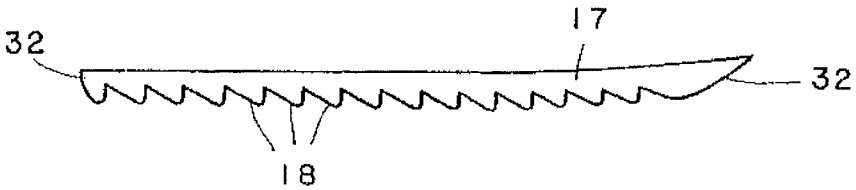
FIG. 6 is a side elevation showing an outsole insert of a configuration associated with a woman's shoe with an elevated heel.
Figure 7:
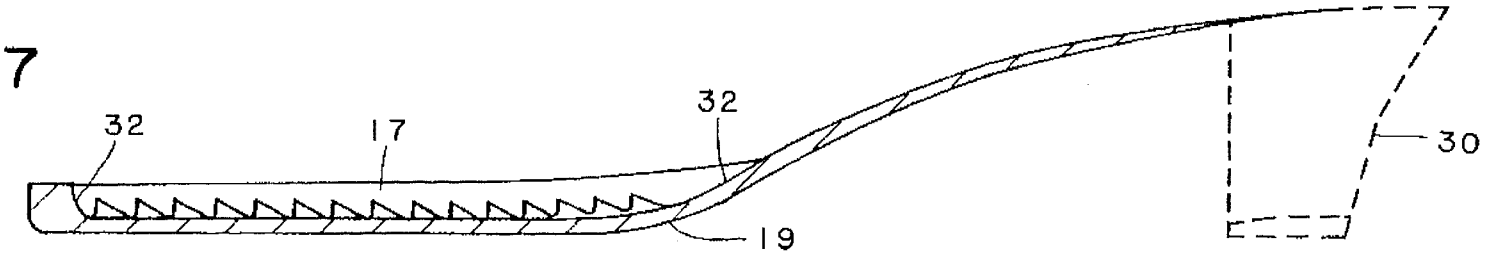
FIG. 7 is a side elevation, with the outsole in section, showing the woman's shoe associated with the FIG. 6 insert.
Figure 8:
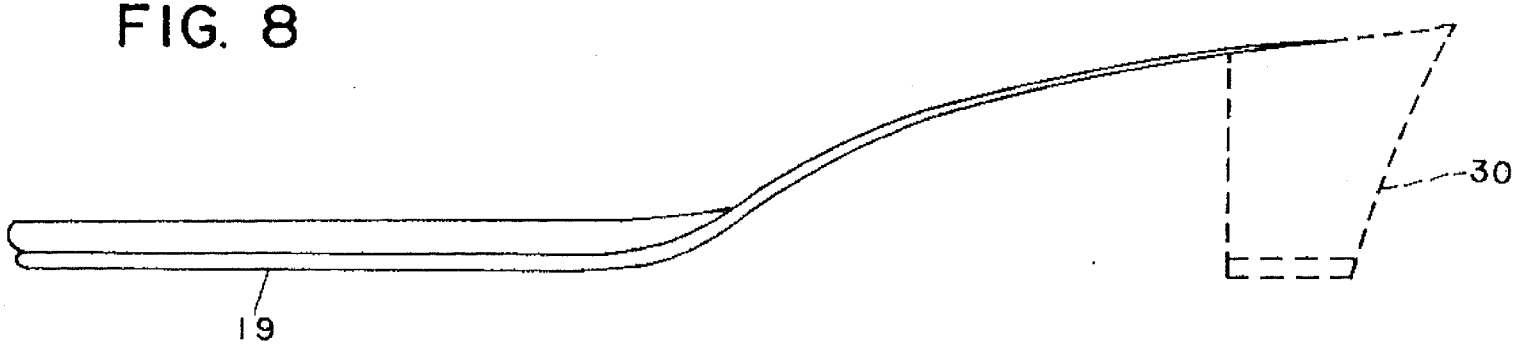
FIG. 8 is a side elevation of a shoe incorporating the FIG. 7 construction.

FIG. 6 illustrates an outsole insert of a configuration appropriate to the usual woman's shoe, in which an elevated heel 30 is used. The insert 17 has the same rib arrangement 18 as that appearing in FIG. 3. In FIG. 7, an outsole 19 is shown in section, in a configuration adapted to receive the insert 17 in a recess in the upper surface of the outsole. The upper structure of the shoe is cemented at edges 32 to the assembly, as shown in FIG. 7. FIG. 8 provides a side elevation of the outsole assembly, showing that the insert does not increase the thickness of the sole.

Figure 9:
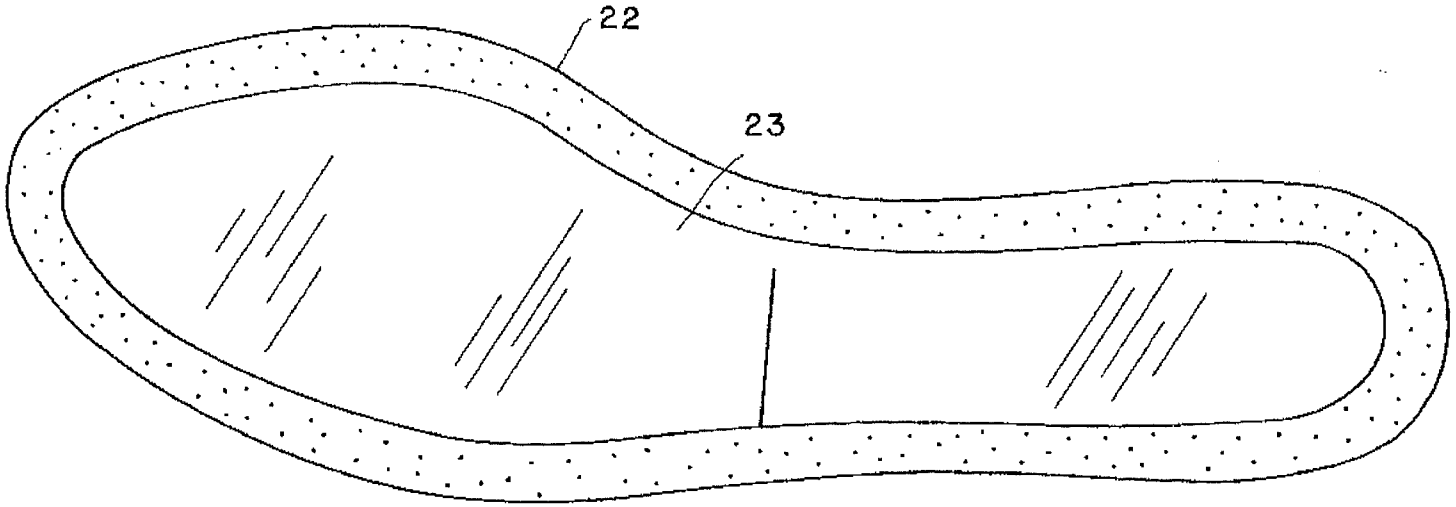
FIG. 9 is a bottom view of an outsole adapted to receive the FIG. 5 insert, and with the central portion constructed of a translucent or transparent material.

FIG. 9 shows an outsole element 22 in which the major portion of the central area of the shoe is constructed of a translucent or transparent material indicated at 23, which is planar in the sense that it has no surface discontinuities which would distort light. This arrangement permits a view of the interior of the shoe, primarily to display the presence of a shock-absorbing ribs of the outsole insert. The area shown at 23 may also be divided into separate front and rear sections so that the ribs 14 and 15 of FIG. 3 are visible through their respective areas. This arrangement is desirable for showing a prospective purchaser of the shoe the details of the inner shock-absorbing construction. As the use of the shoe continues, the outsole (even though originally fully transparent) will become scuffed to the point where it is translucent. It will, however, have achieved its original purpose of informing the purchaser of what he is buying. This is much better than relying on the mere word of the salesman as to what is going on inside the shoe. As an alternative, a transparent window 50 can be positioned in the side edge of the outsole (FIG. 1), in order to show the side edge of the ribbed insert.

I claim:

1. A sole assembly for a shoe, said sole assembly comprising:

an outsole defining an upwardly opening recess having sole and heel portions; and an insert within said recess and including a plurality of downwardly extending ribs engaging said outsole, each of said ribs being uniform in height across the width of said insert and each having a rounded triangular cross section, said ribs within said heel portion of said recess being inclined from the vertical forwardly toward said sole portion, said ribs within said sole portion of said recess being inclined from the vertical rearwardly toward said heel portion.

2. A sole assembly as defined in claim 1 wherein:

said outsole includes a peripheral edge portion having a thickness; and said outsole in the area of said recess and said insert together having a thickness substantially the same as said edge portion thickness.

3. A sole assembly as defined in claim 1 wherein said outsole further defines a window permitting viewing through said outsole of at least selected ribs.

4. A shoe comprising:

an upper;

an outsole defining an upwardly opening recess, said upper secured to said outsole; and an insert within said outsole recess and including a plurality of downwardly extending transverse ribs, each of said ribs being of uniform height along its length and including an upper portion and a lower portion, said lower portions engaging said outsole, each of said ribs having a rounded triangular cross section, each of said ribs being relatively thick at its upper portion and relatively narrow at its lower portion, said insert having sole and heel portions, said ribs extending from said sole portion inclined rearwardly from the vertical toward said heel portion, said ribs extending from said heel portion inclined forwardly from the vertical toward said sole portion.

5. A shoe as defined in claim 4 wherein said outsole defines a window through which at least selected ones of said ribs can be viewed.

6. A shoe as defined in claim 4 wherein:

said outsole includes a peripheral edge having a thickness; and said outsole in the area of said recess and said insert together have a thickness generally the same as said peripheral edge thickness.

7. A shoe as defined in claim 6 wherein said upper is secured to said peripheral edge of said outsole.

8. A shoe comprising:

an outsole having forward and rearward portions and a peripheral edge portion, said outsole defining an upwardly opening recess in said forward and rearward portions;

an upper secured to said edge portion of said outsole; and insert within said recess and including a plurality of downwardly extending transverse ribs engaging said outsole, each of said ribs being uniform in height throughout its length and each having triangular cross section and a rounded bottom apex, said ribs in said forward portion being rearwardly inclined from the vertical, said ribs in said rearward portion being forwardly inclined from the vertical.

9. A shoe as defined in claim 8 wherein said outsole defines a window portion providing viewing of at least selected ones of said ribs.

10. A shoe as defined in claim 8 where said edge portion has a thickness, said outsole in the area of said recess and said insert together have a thickness matching said edge portion thickness.

11. A shoe as defined in claim 8 wherein said insert includes a peripheral edge, said insert being affixed to said outsole only at said insert peripheral edge, whereby said ribs may move freely against said outsole.

* * * * *